US008047171B2

(12) United States Patent
Strauss et al.

(10) Patent No.: US 8,047,171 B2
(45) Date of Patent: Nov. 1, 2011

(54) DEVICE FOR SETTING THE RELATIVE ROTATIONAL POSITION OF A CAMSHAFT OF AN INTERNAL COMBUSTION ENGINE RELATIVE TO A CRANKSHAFT DRIVING THE CAMSHAFT

(75) Inventors: Andreas Strauss, Forchheim (DE); Joachim Dietz, Frensdorf (DE); Boris Putz, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 337 days.

(21) Appl. No.: 12/359,499

(22) Filed: Jan. 26, 2009

(65) Prior Publication Data

US 2009/0188453 A1 Jul. 30, 2009

Related U.S. Application Data

(60) Provisional application No. 61/023,465, filed on Jan. 25, 2008.

(51) Int. Cl.
*F01L 1/34* (2006.01)

(52) U.S. Cl. ..... 123/90.17; 123/90.15; 123/90.31; 464/160

(58) Field of Classification Search ..... 123/90.27, 123/90.31, 90.15, 90.16, 90.17, 90.18; 464/1, 464/2, 160
See application file for complete search history.

(56) References Cited

U.S. PATENT DOCUMENTS 4,915,066 A * 4/1990 Koshimoto et al. ..... 123/90.27
6,325,033 B1 * 12/2001 Iwata ..... 123/90.31

FOREIGN PATENT DOCUMENTS

DE 19820534 11/1999

* cited by examiner

*Primary Examiner* — Ching Chang
(74) *Attorney, Agent, or Firm* — Volpe and Koenig, P.C.

(57) ABSTRACT

A device for setting the relative rotational position of a camshaft (2, 3) of an internal combustion engine (11) relative to a crankshaft (1) driving the camshaft (2, 3), having a traction mechanism drive (4) wrapping around the crankshaft (1) and the camshaft (2, 3), which includes a loaded traction-mechanism section (8, 9) and a non-loaded traction-mechanism section (7), and a tensioning device (5, 6, 10) for changing the length of the loaded traction-mechanism section (8, 9). The tensioning device (5, 6, 10) is supported on the internal combustion engine (11) and has an adjustment device (20) that can be fixed.

5 Claims, 4 Drawing Sheets

DEVICE FOR SETTING THE RELATIVE ROTATIONAL POSITION OF A CAMSHAFT OF AN INTERNAL COMBUSTION ENGINE RELATIVE TO A CRANKSHAFT DRIVING THE CAMSHAFT

CROSS-REFERENCE TO RELATED APPLICATIONS

This application claims the benefit of U.S. Provisional Application No. 61/023,465, filed Jan. 25, 2008, which is incorporated herein by reference as if fully set forth.

BACKGROUND

The invention relates to a device for setting the relative rotational position of a camshaft of an internal combustion engine relative to a crankshaft driving the camshaft, with a traction mechanism drive wrapping around the crankshaft and the camshaft, having a loaded traction-mechanism section and a non-loaded traction-mechanism section, and a tensioning device for changing the length of the loaded traction-mechanism section.

A device according to this class is known, e.g., from DE 198 20 534 C2, where in the loaded traction-mechanism section there is a hydraulically actuated tensioning device supported opposite the non-loaded traction-mechanism section. A disadvantage in this device is that it requires a support on an opposite non-loaded traction-mechanism section. Furthermore, the hydraulic adjustment cylinder is not pressurized when the internal combustion engine is stopped, so that adjustment is not possible when the internal combustion engine is stopped.

SUMMARY

The objective of the invention is to create a device in which the relative rotational position of the camshaft relative to the crankshaft is possible even for an internal combustion engine that is stopped.

The solution to this objective is realized in that the tensioning device is supported on the internal combustion engine and has an adjustment device that can be fixed.

Through the device provided according to the invention, an option is created for adjusting the relative rotational position of the camshaft relative to the crankshaft before the internal combustion engine is started. Because the adjustment device according to the invention can be fixed, it is guaranteed that the set relative rotational position of the camshaft relative to the crankshaft is also maintained, in particular, during the operation of the internal combustion engine. If the set rotational position should change while the internal combustion engine is running due to wear or other external influences, then obviously this could be readjusted with the adjustment device.

The adjustability can be further improved in that a second tensioning device is provided in the non-loaded traction-mechanism section.

For the case that the traction mechanism drive wraps around at least two camshafts, it is provided that a tensioning device is provided both in the loaded traction-mechanism section between the camshafts and also in the loaded traction-mechanism section between the crankshaft and the camshafts. Thus, the rotational positions of the camshafts relative to the crankshaft can be adjusted individually.

It is further provided that several tensioning devices are allocated to a loaded traction-mechanism section, whereby an option is created to also tension very long loaded traction-mechanism sections and/or to adjust the tensioning device to a certain geometric profile of the loaded traction-mechanism section and/or to define a desired profile for the loaded traction-mechanism section.

One structural type of construction of the tensioning device provides constructing these from a pivoting sliding rail, wherein the tensioning device then takes over the function of guiding the traction mechanism in addition to the function of tensioning.

BRIEF DESCRIPTION OF THE DRAWINGS

The invention will be explained in greater detail below with reference to a preferred embodiment, wherein details are identified in the Figures. Shown are.

DETAILED DESCRIPTION OF THE PREFERRED EMBODIMENTS

Figure 1:
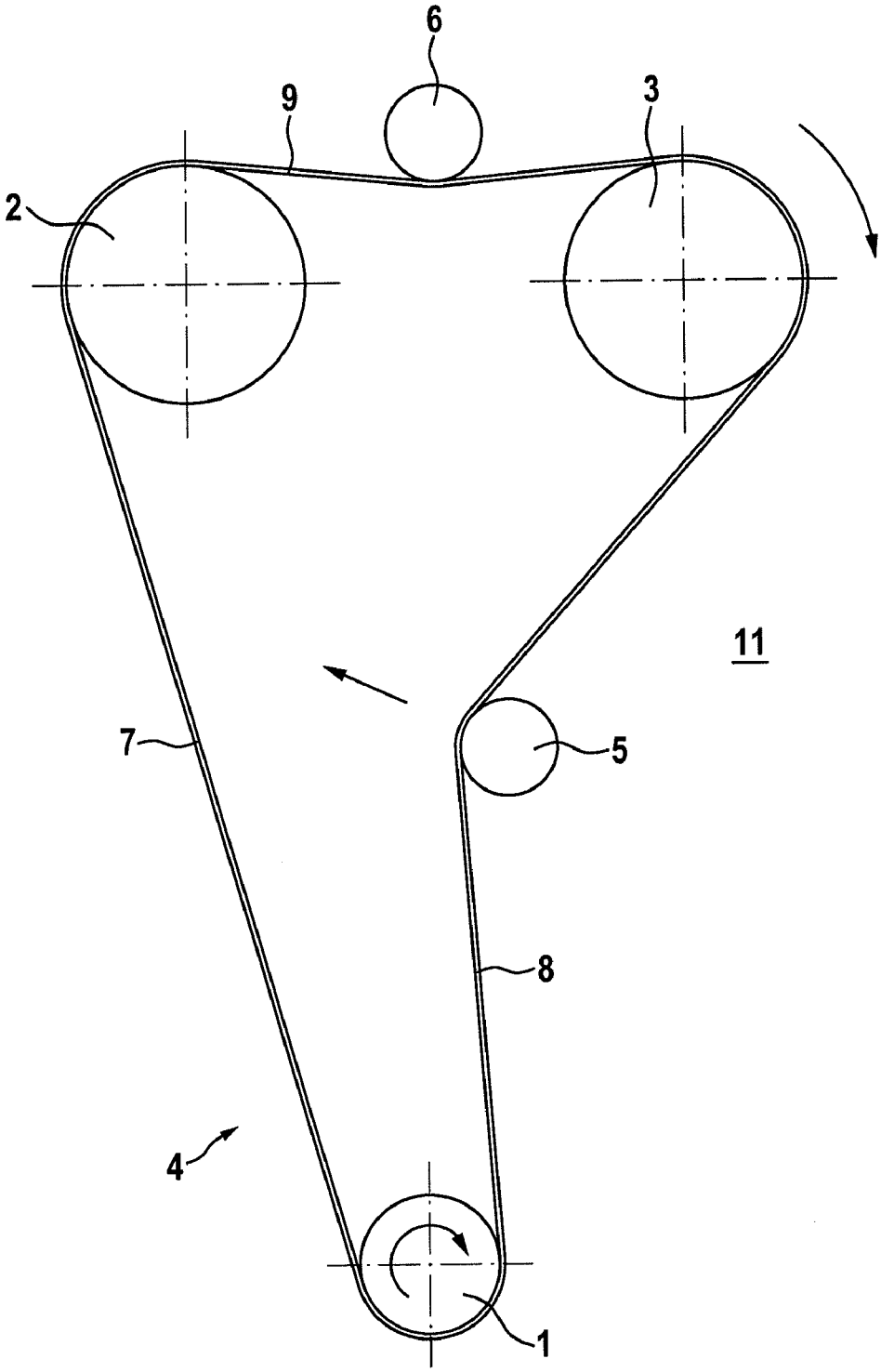
FIG. 1: a view of crankshaft and camshafts with a traction mechanism drive and tensioning device.

In FIG. 1, a crankshaft 1 and two camshafts 2 and 3 are illustrated schematically on a front side of an internal combustion engine 11 that is arranged in the background but is not shown. The rotational movement of the crankshaft 1 running in the clockwise direction is transmitted by a traction mechanism drive 4 to the camshafts 2 and 3. As the traction mechanism, e.g., slide chains, toothed belts, or friction belts can be used. The traction mechanism drive 4 can be divided due to its rotational direction into the loaded traction-mechanism sections 8 and 9 and the non-loaded traction-mechanism section 7. Tensioning devices 5 and 6 are arranged in the loaded traction-mechanism sections 8 and 9, respectively. Through the tensioning devices 5 and 6, a change in length in the loaded traction-mechanism sections 8 and 9 can be generated through which the relative rotational position of the camshafts 2 and 3 can be adjusted individually relative to the crankshaft 1. The camshafts 2 and 3 are each allocated either to the intake or the exhaust valves of the internal combustion engine 11, so that through the change in the rotational position of the camshafts 2 and 3, the opening and closing time points of the valves are changed. The adjustment of the relative rotational position of the camshafts 2 and 3 relative to the crankshaft 1 is performed once before the internal combustion engine 11 starts by the tensioning devices 5 and 6, and is no longer changed while the internal combustion engine 11 is running. This obviously does not also exclude a dynamic camshaft adjustment while the internal combustion engine is running through camshaft adjusters acting directly on the camshafts 2 and 3.

The invention is especially advantageous if the dynamic camshaft adjustment is performed by a camshaft adjuster that has a drive element driven by the crankshaft 1 and a camshaft-fixed driven element, wherein the driven element is fixed with the camshaft 2, 3. In this case, during the assembly of the camshaft adjuster on the camshaft 2, 3, deviations in position between the driven element and the camshaft 2, 3 can appear in the peripheral direction that can no longer be corrected at a later time. Through the use of the described invention, it is possible to compensate the deviations in position after the assembly of the camshaft adjuster through the modification of the chain guide. For this purpose, the chain guide is changed such that the driving element is rotated by the magnitude of the deviation in position relative to the driven element. Then the chain guide is fixed in this state.

Figure 2:
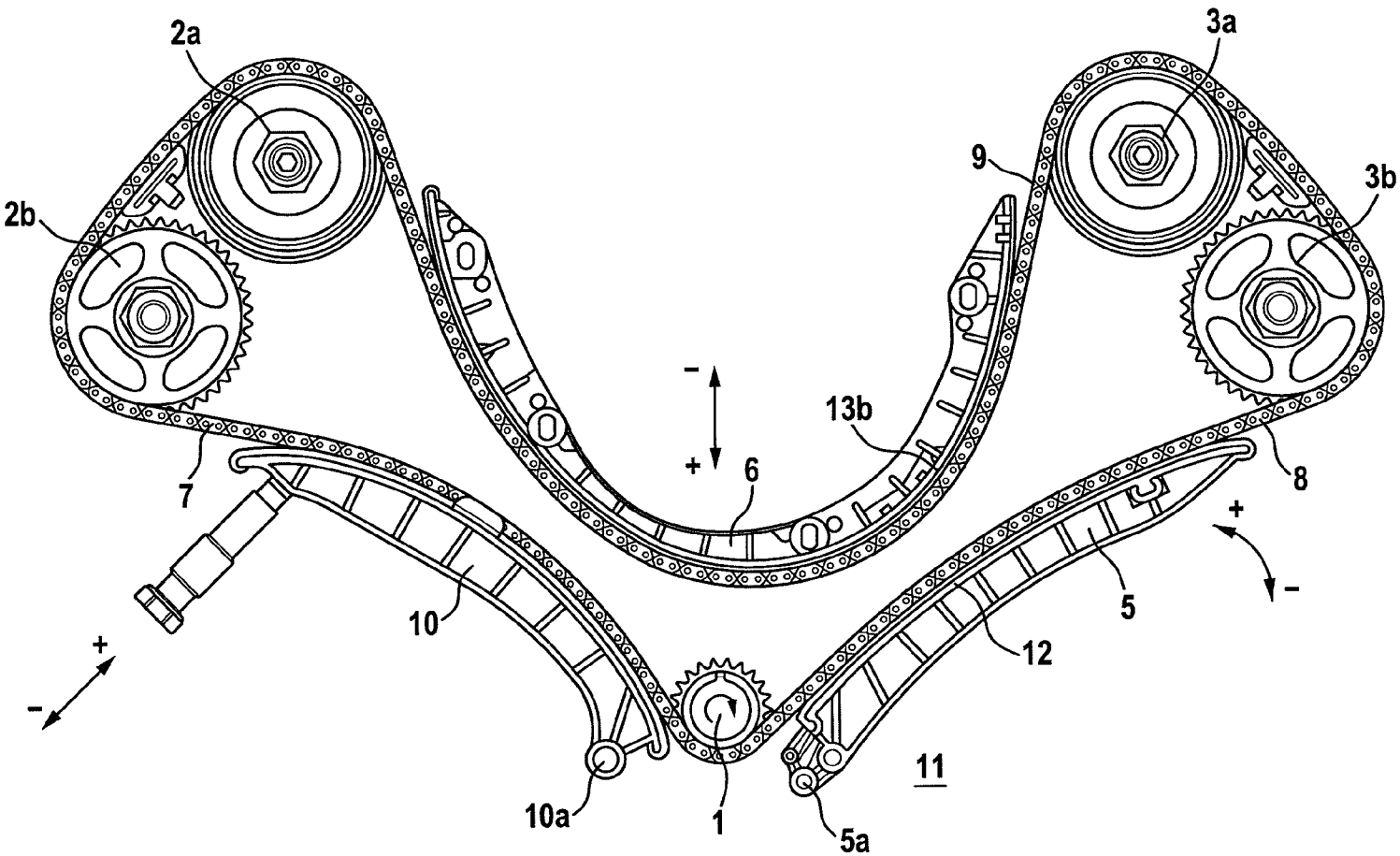
FIG. 2: a view of crankshaft and camshafts with a traction mechanism drive and length-adjustable and pivoting tensioning devices.
Figure 3:
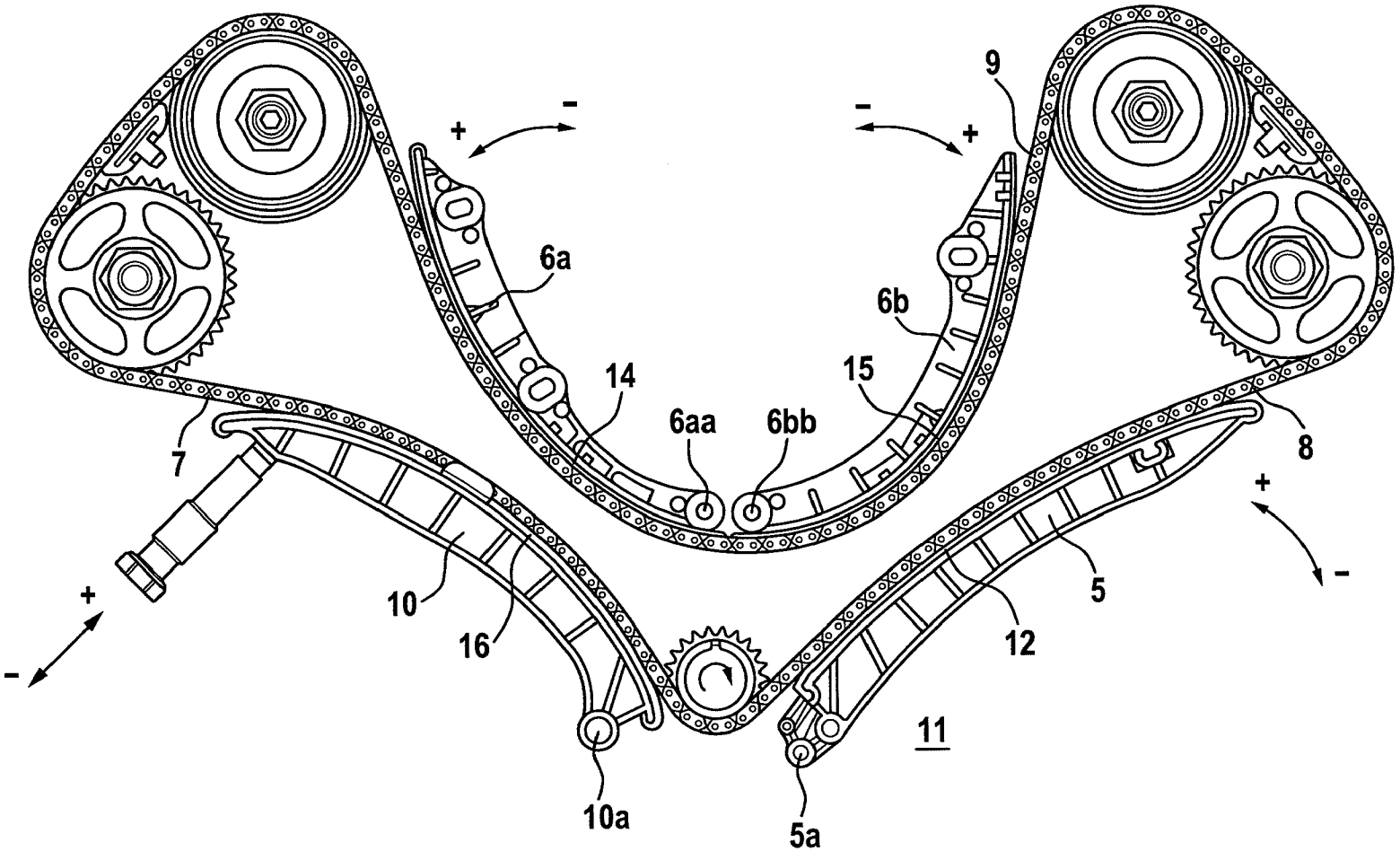
FIG. 3: a view of crankshaft and camshafts with a traction mechanism drive and several tensioning devices in the loaded traction-mechanism section between the camshafts.
Figure 4:
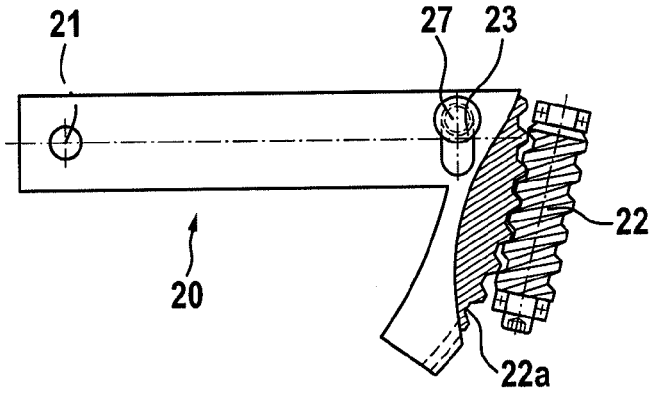
FIG. 4: a view of an adjustment device with worm drive.

In FIGS. 2 and 3, another embodiment of the invention is shown in which an internal combustion engine 11 is to be seen with a two-row cylinder arrangement. Each cylinder row is provided with a camshaft pair 2*a*, 2*b* and 3*a*, 3*b*, wherein each actuates the intake and exhaust valves. In addition to the tensioning devices 5 and 6 in the loaded traction-mechanism sections 8 and 9, here a tensioning device 10 is provided in the non-loaded traction-mechanism section 7. The tensioning device 10 has the task, as known sufficiently in the state of the art, to keep the non-loaded traction-mechanism section 7 under tension. The adjustment movements of the tensioning devices 5, 6 and 10 are designated with "+/−" in the arrow directions. The tensioning devices 5, 6 and 10 are constructed as sliding rails 12, 13, 14, 15, and 16 and set the profile of the traction mechanism drive 4 through their contours. The tensioning device 6 in FIG. 2 has a linear displaceable construction, while the tensioning devices 5 and 10 can pivot rotatably about the rotational points 10*a* and 5*a*. In FIG. 3, the tensioning device 6 is formed alternatively from two individual tensioning devices 6*a* and 6*b* that can pivot about the rotational points 6*aa* and 6*bb*. The rotational points 5*a*, 6*aa*, 6*bb* and 10*a* are fixed in position on the internal combustion engine 11 and are used as abutments for the forces exerted on the tensioning devices 5, 6, and 10 by the traction mechanism. The linear adjustment movement of the tensioning device 6 in FIG. 2 and the two-part construction of the tensioning device 6*a* and 6*b* in FIG. 3 offer the advantage that the relatively long loaded traction-mechanism section 9 can be changed sufficiently in length, without changing the characteristic profile of the loaded traction-mechanism section 9. In this way it is prevented that undesired radii are formed by the tensioning device 6 in the traction mechanism and thus its profile can be distorted. Furthermore, the present construction offers the advantage that the forces exerted by the traction mechanism on the tensioning device 6, 6*a*, 6*b* are distributed as uniformly as possible on this device and thus unnecessarily high loads introduced into the tensioning device 6, 6*a*, 6*b* are prevented.

Figure 5:
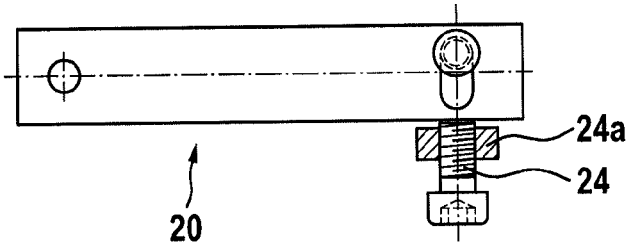
FIG. 5: a view of an adjustment device with an adjustment screw.
Figure 6:
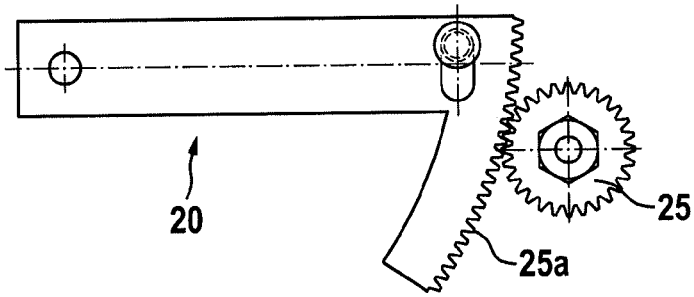
FIG. 6: a view of an adjustment device with a gearwheel.
Figure 7:
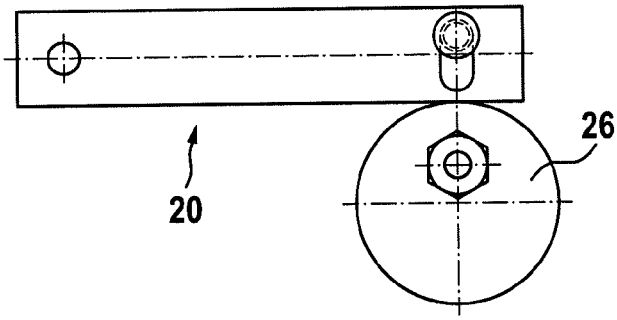
FIG. 7: a view of an adjustment device with an eccentric.

In FIGS. 4 to 7, different embodiments of an adjustment device 20 are illustrated by which the tensioning devices 5, 6, and 10 can be adjusted. The tensioning devices 5, 6, and 10 can be constructed integrally with the adjustment device 20 or can be connected to this device with a non-positive fit. The adjustment device 20 is fixed in position at a rotational point 21 on the internal combustion engine 11. As long as the adjustment device 20 and the tensioning device 5, 6, 10 are constructed integrally, the rotational points 21 are advantageously identical with the rotational points 5*a*, 6*aa*, 6*bb*, 10*a*. The adjustment device 20 has an essentially elongated rail that is supported so that it can pivot on its one end in the rotational point 21 and has an elongated hole 23 running in the adjustment device on its other end. In the embodiment shown in FIG. 4, the adjustment is performed with a worm gear 22 that meshes in teeth 22*a* arranged on the adjustment device 20. The rotational movement of the worm gear 22 is converted by the teeth 22*a* into a pivoting movement of the adjustment device 20. In FIG. 5, as an alternative for the adjustment, an adjustment screw 24 is to be seen that is screwed into a threaded borehole of a fixed support 24*a* and contacts the adjustment device 20 with the front end of its threaded journal. The pivoting movement of the adjustment device 20 is here generated by rotation of the adjustment screw. In FIG. 6, another option for generating the pivoting movement of the adjustment device 20 is to be seen in which teeth 25*a* are provided on the adjustment device 20 with which a gearwheel 25 meshes. The pivoting movement of the adjustment device 20 is here reached by rotating the gearwheel 25. In FIG. 7, an alternative embodiment of the adjustability through the use of an eccentric 26 is shown, wherein here the adjustment is implemented through rotation of the eccentric.

After setting the rotational position of the camshafts through adjustment of the adjustment device 20, the position of the adjustment device 20 can be secured by a separate fixing screw 27. Alternatively, the pairings of teeth and thread can be constructed also in a self-locking way, so that the adjustment device 20 is fixed in this after setting the desired position.

The invention claimed is:

1. A device for setting the relative rotational position of a camshaft of an internal combustion engine relative to a crankshaft driving the camshaft, comprising a traction mechanism drive wrapping around the crankshaft and the camshaft that has a loaded traction-mechanism section and a non-loaded traction-mechanism section, and a tensioning device for changing a length of the loaded traction-mechanism section, the tensioning device is supported on the internal combustion engine and has an adjustment device that allows an adjustable movement of the tensioning device, and after the adjustable movement to set a relative rotational position of the camshaft relative to the crankshaft, the adjustment device secures the tensioning device in a fixed position prior to starting the internal combustion engine.

2. The device according to claim 1, wherein a second tensioning device is provided in the non-loaded traction-mechanism section that can also be fixed in position.

3. The device according to claim 1, wherein the traction mechanism drive wraps around at least two camshafts and there are at least two of the tensioning devices so that one of the tensioning devices is provided in a loaded traction-mechanism section between the two camshafts and one of the tensioning devices is provided in the loaded traction-mechanism section between the crankshaft and one of the camshafts.

4. The device according to claim 1, wherein several of the tensioning devices are allocated to one of the loaded traction-mechanism sections.

5. The device according to claim 1, further comprising a second tensioning device that maintains the non-loaded traction-mechanism section under tension.

* * * * *